United States Patent [19]

Weipert

[11] 4,169,062

[45] Sep. 25, 1979

[54] RANDOM COPOLYMERS OF POLYOXYETHYLENE POLYOXYPROPYLENE GLYCOL MONOESTER, PROCESS OF MAKING THE SAME AND TEXTILE FIBER CONTAINING THE SAME

[75] Inventor: Eugene A. Weipert, College Park, Ga.

[73] Assignee: Southern Sizing Co., East Point, Ga.

[21] Appl. No.: 921,165

[22] Filed: Jul. 3, 1978

Related U.S. Application Data

[63] Continuation of Ser. No. 796,444, May 12, 1977, abandoned, which is a continuation of Ser. No. 513,217, Oct. 9, 1974, abandoned.

[51] Int. Cl.[2] ..... D06M 13/10

[52] U.S. Cl. ..... 252/8.9; 8/115.6; 252/8.6; 252/8.7; 252/52 R; 428/394; 568/619

[58] Field of Search ..... 252/8.9, 8.7, 8.6, 52 R; 8/115.6 A; 428/394; 568/619

[56] References Cited

U.S. PATENT DOCUMENTS

| | | | |
|---|---|---|---|
| 1,970,578 | 8/1934 | Schoeller et al. | 252/8.7 |
| 2,457,139 | 12/1948 | Fite et al. | 568/619 |
| 2,620,304 | 12/1952 | Stewart et al. | 252/52 R |
| 2,665,443 | 1/1954 | Simon et al. | 260/785 |
| 2,690,426 | 9/1954 | Jefferson et al. | 252/8.9 |
| 2,694,021 | 11/1954 | Griffin | 252/8.9 |
| 2,964,470 | 12/1960 | Wentworth | 252/8.9 |
| 3,676,199 | 11/1972 | Hewitt et al. | 428/407 |
| 3,770,701 | 11/1973 | Canker et al. | 568/619 |

*Primary Examiner*—William E. Schulz

*Attorney, Agent, or Firm*—Newton, Hopkins & Ormsby

[57] ABSTRACT

A textile fiber lubricant, namely random copolymers of polyoxyethylene polyoxypropylene glycol monoester produced by the condensation reaction of an aliphatic fatty acid, or acids having from about 8 to about 22 carbons in the chain, with a mixture of ethylene oxide and propylene oxide, in the presence of an alkali catalyst. These fatty esters are water soluble, biodegradable and exhibit superior lubricating properties when applied to synthetic fibers.

The esters have the empirical formula:

$$R-\overset{\overset{\displaystyle O}{\|}}{C}-O-(M)H$$

wherein R is an aliphatic chain having from about 7 to about 21 carbon atoms and M is a random mixture of oxyethylene [$-CH_2.CH_2.O-$] and oxypropylene [$-CH_2.CH(CH_3).O-$] groups.

21 Claims, No Drawings

RANDOM COPOLYMERS OF POLYOXYETHYLENE POLYOXYPROPYLENE GLYCOL MONOESTER, PROCESS OF MAKING THE SAME AND TEXTILE FIBER CONTAINING THE SAME

This is a continuation, of application Ser. No. 796,444, filed May 12, 1977 which was a continuation of application Ser. No. 513,217, filed Oct. 9, 1974 both now abandoned.

BACKGROUND OF THE INVENTION

1. Field of the Invention

This invention relates to textile lubricants and is more particularly concerned with random copolymers of polyoxyethylene polyoxypropylene glycol monoester and a process of producing the same. The invention is also concerned with a lubricated synthetic fiber.

2. Description of the Prior Art

I am aware of U.S. Pat. No. 3,770,701, U.S. Pat. No. 2,620,304 and U.S. Pat. No. 2,457,139 which I consider to be the most pertinent references. I am the co-inventor of the surfactant described in U.S. Pat. No. 3,770,701.

It is well-known that essentially all synthetic textile fibers as originally produced cannot be processed into yarn and fabric in textile mills because of snagging, clinging and breaking that results from a lack of lubrication and/or static electricity. These processing difficulties, however, are usually overcome by the application of "textile lubricants" or "fiber finishes" to the fibers.

The traditional fiber finishes used on synthetic textile fibers are made up of three components. The first ingredient is the basic lubricants. Most widely used for the lubricant is either a mineral oil or a fatty ester (e.g. butyl stearate). The second ingredient is an antistatic agent to reduce static electricity which is common to nearly all synthetic fibers and especially those with low moisture regain properties. Anti-static agents are generally of the cationic (quaternary amine or imidazolinium salts) or anionic type (salts of partial esters of phosphoric acid). The third ingredient, is the emulsifying agent. It is necessary to use an emulsifying agent since an even application of finish components is best achieved from a dilute aqueous emulsion. Emulsifying agents commonly employed are nonionic (polyoxyethylene ethers and esters) or anionic (salts of akyarylsulfonic acids). The patent to Fortess, et al, U.S. Pat. No. 2,730,498 discloses a typical finish.

The lubricants used heretofore have many drawbacks, but chief among them is their volatility. In other words lubricants have objectionable vapors which are released in the area around the yarn or fiber drying equipment.

Water insolubility of mineral oil and fatty ester lubricants is another problem. When a lubricant is water insoluble it is usually difficult to apply to the fiber. To overcome this, the lubricant is emulsified with the water. The nonuniformity and instability of these emulsions frequently results in the uneven application of the lubricant to the fibers. Processing problems usually result from this uneven application. Even when excellent emulsions are prepared, the relatively large proportion of emulsifying agent necessary in the emulsion has a negative effect on the lubrication of the fibers.

Another problem with oily lubricants is that they are difficult to remove from the fibers after these fibers have been processed into textile yarn or fabric. The scouring of these oil bearing fabrics must be thorough and complete since spotty and uneven dyeing of the fabrics and poor hand characteristics will result.

Still another problem is that the lubricant must be disposed of after it is scoured off. Disposal, by way of sewering at the textile mill, results in an oil film or slick in nearby streams and ponds. This oil is only very slowly decomposed by bacteria, if at all.

In the past, attempts have been made to overcome the problems described above by using fatty esters of polyoxyethylene glycols, as the lubricants or emulsifiers. These attempts have met with limited success in some special circumstances. The failure of these products to completely resolve the difficulties, results from the nature of the materials involved. In order to achieve good lubrication from the fatty acid portion of the product, it is necessary for the fatty hydrocarbon chain be as long as feasible, at least eight carbons long and preferably greater than twelve. In order to make esters of such acid water soluble, it is necessary to employ proportionately longer polyoxyethylene glycol chains. This results in pasty solid products or high viscosity liquids which are too thick for use in the high speed processing of textile fibers.

Surfactants and lubricants are known having an aliphatic alcohol or carboxylic acid and a series of oxyethylene groups, as for example U.S. Pat. No. 2,457,139 to Fife, et al. However, such compounds are generally speaking unsatisfactory for high-speed textile fabrication uses, either because they are water insoluble or too viscous or have insufficient hydrocarbon chain content. The problems described above are believed to be overcome by the lubricants of the present invention.

SUMMARY OF THE INVENTION

Briefly described, the process of the present invention includes comingling a fatty acid or acids with a mixture of ethylene oxide and propylene oxide under condensation reaction conditions to produce a fatty ester having an aliphatic chain containing 8 to 22 carbons. The resultant lubricant has superior lubricating properties and is readily and easily applied to synthetic fibers, it being water soluble, liquid at room temperature, and biodegradable.

Accordingly, it is a principal object of the present invention to provide a liquid, water soluble, biodegradeable textile fiber lubricant with proper viscosity and hydrocarbon length to function as a textile lubricant for synthetic fibers and a process of producing the same.

Another object of the present invention is to provide a lubricant for synthetic fibers which is inexpensive to manufacture, easily handled, readily applied to the fibers and efficient in operation.

Another object of the present invention is to provide a lubricant for synthetic fibers which can be uniformly applied to the fibers and will enable the fibers to be processed without appreciable variation in pick-up or "hand".

Another object of the present invention is to provide a lubricant for synthetic fibers which under normal conditions requires no external heating, in use, storage or transfer and will not readily separate during bulk storage over an extended period of time.

Another object of the present invention is to provide a synthetic fiber lubricant which is stable at fiber drying temperatures and does not readily steam distill from the fibers when the fibers are heated to these elevated temperatures.

Another object of the present invention is to provide a lubricant for textile fibers which will not be driven off of the fibers during drying and will reduce fire hazards in the exhaust system of a textile mill.

Another object of the present invention is to provide a lubricant which, when applied to fibers, tends to clean the machinery handling the fibers, thereby maintaining the same in a clean condition and removing previously deposited lubricants of a different type.

Another object of the present invention is to provide a lubricant for synthetic staple fibers which is not appreciably effected by the normal pH or changes in the pH of the finish water in which the staple fibers are processed.

Another object of the present invention is to provide a lubricant for synthetic fibers which, when used as a lubricant for synthetic fibers, reduces the amount of heat required to dry the fibers.

Another object of the present invention is to provide a lubricant which when applied to fibers will tenaciously cling to such fibers, thereby reducing the amount of this lubricant required per linear foot of fiber processed and the clean up time for the machinery handling the fiber.

Another object of the present invention is to provide a textile lubricant which when applied to rayon will enhance the speed of carding of the rayon and at the same time reduce its fly on drawing and in slubber or roving formation.

Another object of the present invention is to provide a water soluble lubricant for synthetic fibers which has improved wet-out rates when compared with water insoluble lubricants.

Another object of the present invention is to provide a lubricant for synthetic fibers which will improve the appearance and cleanliness of the card web, the roving package and the quality appearance and hand of the yarn and fabrics produced from fibers containing the lubricant.

Another object of the present invention is to provide a lubricant for synthetic staple rayon fibers which reduces and perhaps eliminates the tackiness of card laps.

Other objects, features and advantages of the present invention will become apparent from the following detailed description of the invention.

DETAILED DESCRIPTION

In more detail, the objects of the present invention are achieved by the hereinafter described water-soluble, liquid, biodegradeable lubricants which have superior lubrication properties for textile fibers, these lubricants being prepared from aliphatic fatty acids, ethylene oxide and propylene oxide. These lubricants are produced by the reaction of a fatty acid or acids having from 8 to 22 carbons, preferably from 12 to 18 carbons in the aliphatic chain, with a mixture of ethylene oxide and propylene oxide in a weight ratio of ethylene oxide to propylene oxide of from about 1.0:1 to about 7.5:1. The lubricants of this invention comprise the composition obtained by reacting, on a weight basis, 40% to 75% ethylene oxide, 10% to 40% propylene oxide and 18% to 35% fatty acid. The resulting random copolymers of polyoxyethylene polyoxypropylene glycol monoester are represented by the following empirical formula:

$$R-\overset{\overset{\displaystyle O}{\|}}{C}-O-(M)H$$

wherein R is an aliphatic chain having 7 to 21 carbon atoms and M is a random mixture of oxyethylene [$-CH_2CH_2O-$] and oxypropylene [$-CH_2CH(CH_3)O-$] groups, said mixture being from about 65% to about 82% of the total weight of the lubricant, the weight ratio of the oxyethylene to the oxypropylene groups of said mixture being in the range of from 1.0:1 to 7.5:1.

The resulting random polyoxyethylene polyoxypropylene glycol monoester has a molecular weight of from about 412 to about 1900, a viscosity of from about 50 Centipoise to about 300 Centipoise at 25° C., is water soluble, creating an aqueous solution up to about 20% by weight in water, at 25° C., has a flash point above 400° F. and a freezing point or range below 68° F. (20° C.).

It is to be understood that, if a mixture of aliphatic or fatty acids is used in the condensation reaction, the product obtained will be a mixture of compounds having the foregoing formula, but differing from each other in the number of carbon atoms in the alkyl group. I have discovered that, only by employing critical amounts of acid, ethylene oxide and propylene oxide can products be prepared which are water soluble, liquid, biodegradable, and posess superior lubrication properties for textile fibers.

Aliphatic or fatty acids which are employed in the preparation of my lubricants are those aliphatic acids which contain from 8 to 22 carbon atoms in the aliphatic chain. Mixtures of these acids may also be used, and are preferred since their use provides a good balance of properties and since these mixtures are readily available from natural, animal and vegetable sources. Aliphatic acids with less than 8 carbon atoms give products having poor lubrication properties (presumably because there is insufficient repetition of $CH_2$ groups common to mineral oil and vegetable oil lubricants). Aliphatic acids with greater than 22 carbon atoms result in products of such high molecular weight that they are highly viscous and would have value as lubricants only under very high temperature conditions, which are not encountered in textile processing. Examples of acids which are operable in the present process include caprylic, pelargonic, capric, lauric, myristic, palmitic, stearic, oleic, linoleic, hydrogenated marine oil fatty acids, isotearic and mixtures thereof.

The products of this invention are prepared by condensing the fatty acid or mixture of acids, as described above, with a mixture of ethylene oxide and propylene oxide. The oxide mixture is preferably added in a single continuous step or in a series of steps to the acid. If added in a series of steps, the oxide ratio in each step need not be in the range, as described, but the total weights after all steps are completed must be in the ratio specified and in the total fraction of the product, as defined.

The ratio of oxides is critical to the properties of the resulting reaction products. If the ethylene oxide:propylene oxide ratio is less than about 1.0:1, the finished product will not be water soluble. If this ratio is greater than about 7.5:1, the finished products (especially from the higher molecular weight fatty acids) will be viscous fluids or pastes.

Furthermore, the weight percent of oxide mixture in the finished product is critical. If the oxide mixture is less than about 65% of the product, then the product will not be water soluble to any appreciable extent. If the oxide mixture is greater than about 82% of the product, then the viscosity of the product will be too high, at ambient temperature, for lubricating of textile fibers if such fiber is to be processed at high speed.

The products of this invention are generally prepared by condensation of the fatty acid or acids with a mixture of ethylene oxide and propylene oxide in the presence of an alkaline catalyst, at temperatures from about 110° C. to about 180° C. and under pressure from ambient pressure up to about 100 psi.

A better understanding of the present invention will be had by reference to the following examples. All parts specified in the examples are by weight.

EXAMPLE I–XVII

The procedure set forth below was repeated for each group of chemicals specified in Table I.

A clean, dry reactor was purged with nitrogen and charged with an aliphatic acid and potassium hydroxide catalyst (1.0–1.5% by weight of the acid). This mixture was stirred at 135° C.–150° C. while a mixture of ethylene oxide and propylene oxide was added to the acid catalyst mixture, over a period of from 4 to 8 hours, at pressures of from 20–100 psi. After about one additional hour, the pressure was stabilized indicating reaction of the oxides was complete. The product was cooled below 100° C., the reactor was vented, the catalyst was neutralized with glacial acetic acid, and the reaction product, discharged.

amount of propylene oxide was too low, resulting in a paste. In Examples VII and XV the amount of propylene oxide was too high resulting in an insoluble liquid. In Example XVI the amount of ethylene oxide was too high resulting in a paste.

Selected products from the above examples were further tested for compatability with commonly used antistatic agents, using seven parts lubricant and one antistatic agent. Table II below gives the results of the tests.

TABLE II

| COMPATABILITY | | | |
|---|---|---|---|
| Example No. of Test | Example Number Lubricant From Table I | Antistatic Agent | Properties of the Mixture |
| XVIII | Ex. III | Atlas G-263(1) | Clear, Completely $H_2O$-Sol. |
| XIX | Ex. X | Nopcostat 092(2) | Clear, Completely $H_2O$-Sol. |
| XX | Ex. XII | GAFAC MC-470(3) | Clear, Completely $H_2O$-Sol. |
| XXI | Ex. XVII | ATLAS G-3780A(4) | Clear, Completely $H_2O$-Sol. |

(1)N-Cetyl-N-ethyl morpholinium ethosulfate
(2)Fatty acid imidazoline
(3)Complex organic phosphate ester
(4)Polyoxyethylene amine condensate To compare the thermal stability of the lubricant of Example III with other similar fiber finishes, beakers containing equal quantities of each were placed side-by-side on a hot plate, and the temperature was allowed to

TABLE I

EXAMPLES OF CONDENSATION REACTIONS AND THE RESULTING PRODUCTS

| | REACTION CHEMICALS | | | | RESULTING LUBRICANT | | | |
|---|---|---|---|---|---|---|---|---|
| EXAMPLE NUMBER | ACID | PROPORTION OF ACID | PROPORTION OF $C_2H_4O$ | PROPORTION OF $C_3H_6O$ | PHASE | SOLUBILITY IN $H_2O$ | VISCOSITY CPS AT 25° C. | FIBER-METAL FRICTION(4) |
| I | Caproic | 25 | 50 | 25 | Liquid | Sol. | 55 | H |
| II | Palargonic | 25 | 50 | 25 | Liquid | Sol. | 75 | M |
| III | Coconut | 25 | 50 | 25 | Liquid | Sol. | 105 | L |
| IV | Coconut | 19 | 54 | 27 | Liquid | Sol. | 145 | M |
| V | Coconut | 40 | 40 | 20 | Liquid | Ins. | 75 | L |
| VI | Coconut | 25 | 75 | 0 | Paste | Sol. | — | H |
| VII | Coconut | 25 | 30 | 45 | Liquid | Ins. | 85 | L |
| VIII | Coconut | 25 | 40 | 35 | Liquid | Sol. | 95 | L |
| IX | Oleic | 25 | 50 | 25 | Liquid | Sol. | 140 | M |
| X | "Monomer"(1) | 25 | 50 | 25 | Liquid | Sol. | 145 | L |
| XI | Stearic (2) | 25 | 50 | 25 | Liquid | Sol. | 150 | L |
| XII | Stearic (2) | 19 | 54 | 27 | Liquid | Sol. | 195 | H |
| XIII | Stearic (2) | 34 | 44 | 22 | Liquid | Sol. | 120 | L |
| XIV | Stearic (2) | 25 | 75 | 0 | Paste | Sol. | — | VH |
| XV | Stearic (2) | 25 | 30 | 45 | Liquid | Ins. | 135 | L |
| XVI | Stearic (2) | 25 | 65 | 10 | Paste | Sol. | — | H |
| XVII | Hyd. Marine (3) | 25 | 50 | 25 | Liquid | Sol. | 155 | H |

(1)Essentially a mixture of oleic and isostearic acid from the "dimer" process.
(2)The stearic acid is derived from hydrogenated tallow.
(3)Fatty acid mixture from hydrogenated marine oil glycerides.
(4)Refers to very heavy (VH), heavy (H), medium (M), or light (L) friction when the lubricant is applied to fibers of spun acrylic carpet yarns, which yarn pulled over a metal pin.

In Table I, it is noted that Examples V, VI, VII, XIV, XV and XVI result in unsuitable products. In Example V the proportion of acid was too high, resulting in a water insoluble liquid. In Examples VI and XIV the rise, rapidly. Careful note was made of the obvious manifestations of decomposition. The results of these experiments are contained in Table III.

Table III

| THERMAL STABILITY | | | | |
|---|---|---|---|---|
| PRODUCT | TIME (min) | TEMP. °C. | COLOR | REMARKS |
| Nopcostat 2152-P | 0 | 25 | Amber | Appearance Prior To |

Table III-continued

| PRODUCT | THERMAL STABILITY TIME (min) | TEMP. °C. | COLOR | REMARKS |
|---|---|---|---|---|
| Atlas G3780-A | 0 | 25 | Amber | Heating Appearance Prior To Heating |
| Example III | 0 | 25 | Straw | Appearance Prior To Heating |
| 2152-P | 40 | 160 | Dk. Red | Smoking |
| G3780-A | 40 | 160 | Red | Smoking |
| Example III | 40 | 160 | Straw | Light Smoke |
| 2152-P | 80 | 180 | Purp-Black | Heavy Smoke |
| G3780-A | 80 | 180 | Purp-Black | Heavy Smoke |
| Example III | 80 | 180 | Light Yellow | Light Smoke |

In order to test the steam volitality of Example III and compare it with similar products, the same were dissolved or dispersed to provide about 0.3% concentration in 150 ml. of tap water. The water was then evaporated at 85° C.–95° C. in an oven in order to simulate conditions in a drying chamber for wet staple fibers. By keeping the temperature below 100° C., the loss of product was assumed to be a function of volatility with water vapor since there was no boiling or entrainment effect. The results of these tests are contained in Table IV.

Table IV

| PRODUCT | STEAM VOLATILITY Initial WEIGHT - g. | FINAL WEIGHT - g. | RESIDUE FROM $h_2O$, g. | % LOSS |
|---|---|---|---|---|
| NOPCO RSF-15 | 0.4755 | 0.3942 | 0.0074 | 18.7% |
| Example III | 0.4482 | 0.4495 | 0.0074 | 1.3% |

Still another test was conducted using the lubricants of Examples III and IX which were respectively applied to acrylic spun carpet yarn and pulled by a weight over a steel pin. An acceptable lubricant under such circumstances would generate less than 220 grams of tension and a prior art acceptable mineral oil type of lubricant generated 195 grams. Yarns treated with Example III developed 145 grams of tension and yarn treated with Example IX developed 140 grams.

In using my lubricant, from about 0.2% to about 3% lubricant based on the weight of the fibers is required. With spun yarns for apparel, my lubricant should comprise about 0.25% of the total weight of the yarn. With the heavier carpet yarn, it should constitute about 0.6% of the total weight of the yarn. In filament yarn for knitting, it should constitute about 1% of the total weight of the yarn and with industrial yarns, such as tire cord, cord for conveyor belts and the like, it should constitute from about 2% to about 3% of the total weight of the cord or yarn.

One advantage of the present lubricant is the fact that it needs no emulsifier to produce a suitable lubricant. In other words, the random copolymers of polyoxyethylene polyoxypropylene glycol monoester of the present invention are suitable for use, as such, or in aqueous solution and can be applied to both monofilament fibers and spun or staple synthetic fibers in the same manner as the prior art finishes are applied. For example, my lubricant can be dribbled onto the fiber mat. The fibers may be dipped into the lubricant and thereafter squeezed or the lubricant may be sprayed onto the fibers.

Furthermore, my lubricant can be mixed with a variety of antistatic agents, when desired. Thus, when used as a lubricant for nylon or polyester fibers, it is recommended that my lubricant be used in conjunction with one of the antistatic agents with which the lubricant is compatible.

My lubricants are particularly useful for lubricating nylon and polyester texturized filament and for rayon staple fiber Also, when minute amounts of my lubricants are to be applied to staple fibers, the lubricant is diluted with water to provide up to about 20%, by weight, an aqueous solution of my lubricant. This is then sprayed onto the staple fiber mat. About a 10% aqueous solution is recommended. After spraying, the water is usually driven off using hot air.

As a rule, my lubricants are applied to synthetic staple yarns immediately after the yarn is cut and prior to the time that the yarns are baled. With monofilament yarns, my lubricants should, be applied, immediately after the fiber is drawn, as by "kiss coating" or by passing the drawn fiber through a bath of my lubricant.

While my lubricants are particularly suitable for application to substantially all synthetic fibers, my lubricant is also useful for application to natural fibers, such as cotton, wool and silk.

From the foregoing description, it should now be apparent that my lubricants, being chemically prepared, have a uniformity which exceeds those natural lubricants of the prior art. Thus, the problems of quality control are reduced. Variation in the pick up and hand of fibers treated with my lubricant are minimum and increases in carding speed is possible when synthetic fibers containing my lubricant are processed.

Furthermore, the lubricant itself requires no special handling in that no external heat, steam tracer lines, or special storage vats are required to store lubricants of the present invention, since they are liquid under ambient conditions. Lubricants of the present invention also do not separate during bulk storage of the same. Other prior art finishes do tend to separate when stored for extended periods of time.

The lubricants of the present invention appear to be stable at temperatures much higher than those temperatures which would be applied to fibers during the drying processes. Furthermore, the lubricants of the present invention do not appear to readily be distilled by steam. This appears to be a major advance, for example, for rayon treated with my lubricants over rayon treated with prior art lubricants which readily distill off of the rayon during the oven drying of the product, and thereby collect in the exhaust systems, causing severe fire hazards.

Indeed, the lubricants of the present invention appear to remain on the fibers even after steam drying, thereby reducing the fire hazard, and reducing the clean up time.

While, heretofore, the machinery utilized in the production of staple fibers become extremely dirty, due to the loss of lubricant during the processing of the staple, the present lubricants appear to have just the opposite effect. For example, when a lubricant of the present invention was employed on rayon fibers, it cleaned up the machinery through which the fibers passed, instead of causing an accumulation of "gunk" on such machinery.

The lubricants of the present invention are not effected by the normal pH changes in the finish water. Indeed, zwhen some prior art lubricants are used, hand can be completely changed with a wash pH change.

Of major economic importance when using the lubricants of the present invention with rayon staple fibers, is the fact that smaller amounts of heat are required to dry the fibers which contains the lubricants of the present invention than rayon which has been treated with prior art lubricants. Thus, a mill can use its existing equipment for drying and by simply adding additional spinnerettes can feed more fiber poundage through this drying equipment, thereby increasing capacity by some 15%-25%.

The lubricants of the present invention, being esters, have a mild pleasant smell and, therefore, imparts this smell to the mill during use. Furthermore, the bales of fibers treated with the present lubricants appear to have a clean smell.

The evenness and uniformity of application of the present lubricants to the fibers appears to be improved over prior art lubricant. When fibers, treated with lubricants of the present invention are used, the finish solution in the mill remains clear and will remain stable without agitation.

The textile cards are able to run at a higher pounds per hour rate when staple fibers using the present lubricants are processed in these cards.

The fly on drawing and especially on roving frames of synthetic fibers treated with my lubricants appears to be less.

The wet-out rate of fibers treated with my lubricants appears to be much faster than fibers treated with prior art lubricants which are water insoluble. This is especially helpful on non-woven fabrics, such as innerliners for disposable diapers.

The resiliency, openness and hand of staple fibers which utilize my lubricants appear to be excellent. With the addition of the good hand which is imparted by the lubricants of the present invention, a mill should have a high rate of confidence in the fiber finished with the lubricants of the present invention. The card web, roving package and yarn has a leaner and cleaner appearance.

The tackiness which is common in card laps from fibers treated with fatty acids, is eliminated when fibers treated with lubricants of the present invention are processed.

What is claimed is:

1. Random polyoxyethylene polyoxypropylene glycol monoester having the formula: R—C—O(M)H wherein R is An alkyl having 7 to 21 carbon atoms and M is a random mixture of oxyethylene and oxypropylene groups.

2. The compound defined in claim 1, said compound being liquid at 20° C. and having a molecular weight of between about 412 and about 1900.

3. The compound defined in claim 1 wherein said mixture is from about 65% to about 82% of the total weight of the compound.

4. The compound defined in claim 1 wherein the weight ratio of oxyethylene to oxypropylene is from about 1.0:1 to about 7.5:1.

5. The compound defined in claim 3 wherein the weight ratio of oxyethylene to oxypropylene is from about 1.0:1 to about 7.5:1.

6. The compound defined in claim 1 wherein the $$R-\overset{\overset{\displaystyle O}{\|}}{C}-O$$

is derived from coconut oil.

7. The compound defined in claim 1 wherein the $$R-\overset{\overset{\displaystyle O}{\|}}{C}-O$$

is derived from hydrogenated tallow.

8. The compound defined in claim 1, said compound being liquid at 20° C. and having a molecular weight of between about 412 and about 1900.

9. A process of preparing a liquid, water soluble, biodegradable, textile fiber lubricant comprising, condensing from approximately 40% to approximately 75%, by weight, ethylene oxide, from approximately 10% to approximately 40% by weight propylene oxide and from about 18% to about 35%, by weight, a fatty acid having from about 8 to about 22 carbons, said ethylene oxide being in proportion to said propylene oxide by weight from about 1.0:1 to about 7.5:1, in the presence of an alkaline catalyst.

10. The process defined in claim 9 including heating the condensation reactants to a temperature of between about 110° C. and about 180° C. at pressures up to about 100 psi for from about 4 to about 8 hours.

11. The process defined in claim 10 wherein said fatty acid is derived from coconut oil.

12. The process defined in claim 10 wherein said fatty acid is derived from hydrogenated tallow.

13. The process defined in claim 10 wherein said fatty acid is a mixture of fatty acids.

14. A lubricated textile fiber comprising (a) A synthetic fiber; and (b) random polyoxyethylene polyoxypropylene glycol monoester on said synthetic fiber wherein the monoester has the formula R—C—0(M)H wherein R is an aliphotic having 7 to 21 carbon atoms and M is a random mixture of oxyethylene and oxypropylene, said mixture being from about 65% to about 82% of the total weight ratio of oxyethylene to oxypropylene in said mixture being in the range of from 1.0:1 to 7.5:1.

15. The lubricated textile fiber defined in claim 14 wherein said random polyoxyethylene polyoxypropylene glycol monoester is in its liquid phase and is biodegradable.

16. The lubricated textile fiber defined in claim 14 wherein said random polyoxyethylene polyoxypropylene glycol monoester constitutes from about 0.2% to about 3% by weight of said synthetic fiber.

17. A mixture consisting essentially of monoesters having the formula

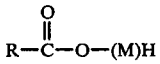

wherein R is alkyl having 7–21 carbons, M is a random series of oxyethylene and oxypropylene with the weight ratio of oxyethylene to oxypropylene is said mixture of monoesters being from about 1.0:1 to about 7.5:1 and said oxyethylene and oxypropylene being from about 65% to about 82% by weight of said mixture of monoesters.

18. A mixture as claimed in claim 17 wherein said mixture is liquid at 20° C., said monoesters have molecular weights between about 412 and about 1900.

19. A mixture as claimed in claim 18 wherein said:

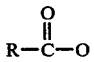

is a mixture of fatty acids derived from the group consisting of hydrogenated tallow and coconut oil.

20. A lubricated textile fiber comprising:

(a) synthetic fiber and (b) a random polyoxyethylene polyoxypropylene glycol monoester mixture on said synthetic fiber consisting essentially of monoesters having the formula:

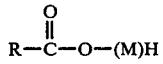

wherein R is alkyl having 7–21 carbons, M is a random series of oxyethylene and oxypropylene with the weight ratio of oxyethylene to oxypropylene in said monoester mixture being from about 1.0:1 to about 7.5:1 and said oxyethylene and oxypropylene being from about 65% to about 82% by weight of said monoester mixture.

21. A lubricated textile fiber as claimed in claim 20 wherein said monoester mixture is liquid at 20° C., said compounds have molecular weights between about 412 and about 1900 and the

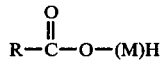

is a mixture of fatty acids derived from the group consisting of coconut oil and hydrogenated tallow.

* * * * *